US007046109B2

(12) United States Patent
Lee

(10) Patent No.: US 7,046,109 B2
(45) Date of Patent: May 16, 2006

(54) MULTI-CONTACT TYPE RELAY BY ELECTROMAGNET

(75) Inventor: Jong Chan Lee, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 288 days.

(21) Appl. No.: 10/751,026

(22) Filed: Dec. 31, 2003

(65) Prior Publication Data

US 2005/0078429 A1 Apr. 14, 2005

(30) Foreign Application Priority Data

Oct. 9, 2003 (KR) ..... 10-2003-0070141

(51) Int. Cl.
*H01H 63/02* (2006.01)

(52) U.S. Cl. ..... 335/133; 335/83; 335/80

(58) Field of Classification Search ..... 335/80, 335/83, 133

See application file for complete search history.

(56) References Cited

U.S. PATENT DOCUMENTS 4,068,202 A * 1/1978 Lyons, III ..... 335/207
4,841,205 A * 6/1989 Bekkema ..... 318/282
4,881,054 A * 11/1989 Polgar ..... 335/230

FOREIGN PATENT DOCUMENTS

JP 2001-185015 7/2001

* cited by examiner

*Primary Examiner*—Phuong T. Vu
*Assistant Examiner*—Terrence Willoughby
(74) *Attorney, Agent, or Firm*—Morgan Lewis & Bockius LLP

(57) ABSTRACT

The present invention relates to a multi-contact type relay in which power is supplied to a load through a BCM (Body Control Module) in accordance with a switching signal from an integration switch, and two coils provided in a relay are selectively activated in accordance with a switching signal from the BCM, so that a fixed contact unit operates based on various contact types in accordance with a movement of a switching part. Therefore, it is possible to fabricate a product as a module, thus resulting in cost reduction and a lightness of a product fabricated thereof.

3 Claims, 7 Drawing Sheets

MULTI-CONTACT TYPE RELAY BY ELECTROMAGNET

CROSS-REFERENCE TO RELATED APPLICATIONS

This application claims priority of Korean Application No. 10-2003-0070141, filed on Oct. 9, 2003, the disclosure of which is incorporated fully herein by reference.

FIELD OF THE INVENTION

The present invention relates to relays in electric and electronic apparatuses. In particular, the present invention relates to a multi-contact type relay in which power is supplied to a load through a BCM (Body Control Module).

BACKGROUND OF THE INVENTION

As shown in FIG. 12, a plurality of wire harnesses are used in a vehicle for connecting many electric and electronic apparatuses. Among the wire harnesses, a wire harness positioned in a vertical direction of the vehicle has a divided intermediate part for easier assembly. Relay 200 is connected to the divided parts. Load 300 is operated in accordance with a switching signal of switch 400 by a controller. In a switching operation by a low current of the controller, power is stably supplied to load 300 operating by AC through relay 200.

As shown in FIG. 1, a plurality of relays are combined, including a common relay system, to implement combined contact types in a relay. One such relay is a multi-contact electromagnetic relay combined with a double make-type relay and a one make-type relay in a base terminal.

However, as the functions of electric and electronic apparatuses in a vehicle become more complicated, a circuit is generally constructed based on a BCM (Body Control Module). The BCM is capable of receiving a plurality of switching signals, and then controlling a plurality of relays based on an on and off operation by interpreting the switching signals. In the past, a turn signal switch, an emergency light signal, and a robbery alarming function were connected to a turn signal lamp relay so that switches and wire connections were very mechanically and electronically complicated. Nowadays, the signals of all switches are inputted into the BCM, and the BCM interprets the sequences of the signals and controls two turn signal relays.

This makes the BCM is becomes a convenient apparatus for vehicles. The BCM is designed to perform various functions such as power window control, wiper motor control, door lock actuator control, robbery prevention control, and room lamp control. The BCM includes a microcomputer having a specific program and a communication electronic device for communication with a LCU (Local Control Unit). There are, however, limits to the BCM's applications. Development of a relay construction in which one relay forms a plurality of load circuits in the vehicle using the BCM is urgently needed.

SUMMARY OF THE INVENTION

The present invention relates to a multi-contact type relay in which power is supplied to a load through a BCM (Body Control Module) in accordance with a switching signal from an integration switch. Two coils in the relay are selectively activated in accordance with a switching signal from the BCM so that a fixed contact unit operates based on various contact types in accordance with a movement of a switching part. Therefore, it is possible to manufacture the product as a module, and a manufacturing cost and the product's weight are thus decreased.

To achieve the above objectives, the present invention includes a relay designed in such a manner that power is supplied to loads through a BCM (Body Control Module) in accordance with a switching signal from an integration type switch. Coils are then activated in accordance with each switching signal from the BCM, thereby forming contacts. The multi-contact type relay controlled by an electromagnet comprises an operational part having three vertical terminals, an E-shaped steel core having a horizontal part horizontally connecting the vertical terminals, and first and second activating coils connected with a power voltage source and wound onto the horizontal part of the steel core; a switching part that is positioned in an upper side of the operational part, and has a permanent magnet and a movable contact that are moved in the left and right directions based on a repulsive force and an attractive force generated by an electromagnetic force of the first and second coils when the coils are activated; and a fixed contact part in an upper side of the switching part and has a plurality of fixed contacts selectively switched with the movable contact of the switching part that is movable in the left and right directions.

Additionally, the first and second activated coils are wound on the horizontal part of the operation unit in the same direction, and the position of the movable contact of the switching part is changed by changing the direction of the current.

BRIEF DESCRIPTION OF THE DRAWINGS

The aforementioned aspects and other features of the present invention will be explained in the following description, taken in conjunction with the accompanying drawings, wherein.

DETAILED DESCRIPTION OF PREFERRED EMBODIMENTS

Hereinafter, such embodiments of the present invention are described in detail with reference to the accompanying drawings.

Figure 1:
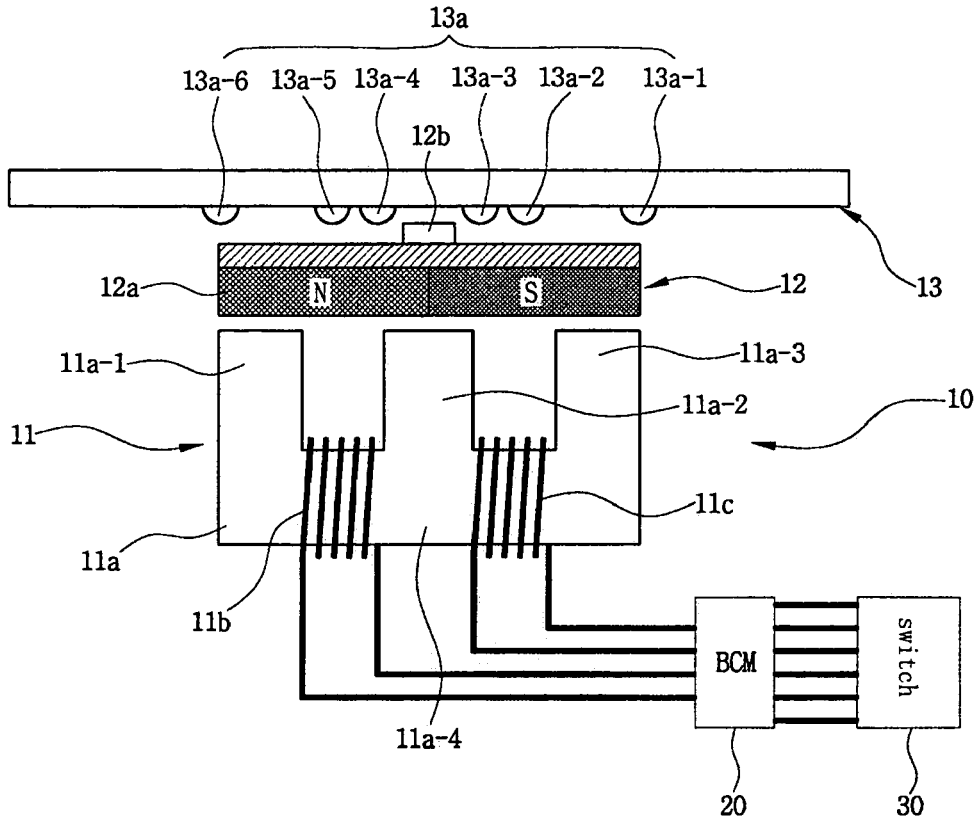
FIG. 1 illustrates the construction of a multi-contact type relay controlled by an electromagnet according to the present invention.

As shown in FIG. 1, relay 10 includes E-shaped steel core 11*a* having three vertical terminal parts 11*a*-1 through 11*a*-3 and a horizontal part 13a horizontally connecting three vertical terminal parts 11*a*-I through 11*a*-3. Relay 10 also includes an operational part 11 having two activated coils 11*b* and 11*c* wound on horizontal part 13*a*-4 of steel core 11. In addition, switching part 12 has a permanent magnet 12*a* and a movable contact 12*b* is positioned in an upper end near operational part 11. Switching part 12 is slidable in horizontally based on the repulsive and attractive forces generated by electromagnetic forces of the activated coils 11*b* and 11*c* wound on operational part 11.

Fixed contact part 13 connected with a load (not shown) is positioned above switching part 12, and fixed contact part 13 includes six fixed contacts 13*a*. Fixed contacts 13*a* are connected with the loads of the vehicle. Switching part 12 is selectively moved based on the position of fixed contacts 13*a* by an electromagnetic force generated in the operational part 11. When power is not supplied to activated coils 11*b* and 11*c* of operational part 11, the center of switching part 12 is aligned with the center of operational part 11 by a magnetic force emanating only from permanent magnet 12*a* of switching part 12.

Figure 2:
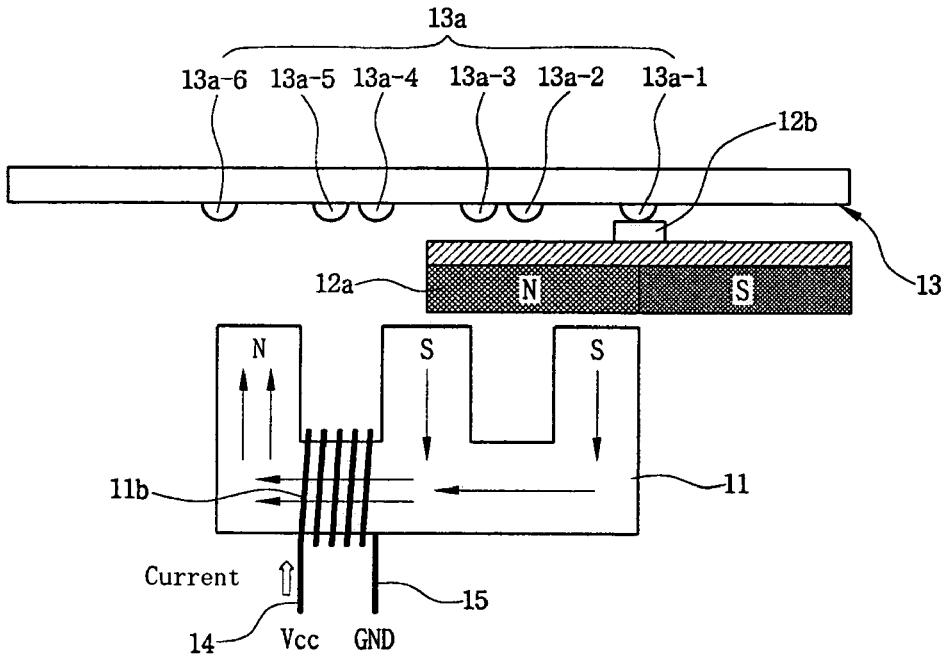
FIG. 2 illustrates an operation state when a current is applied to a first activated coil.
Figure 3:
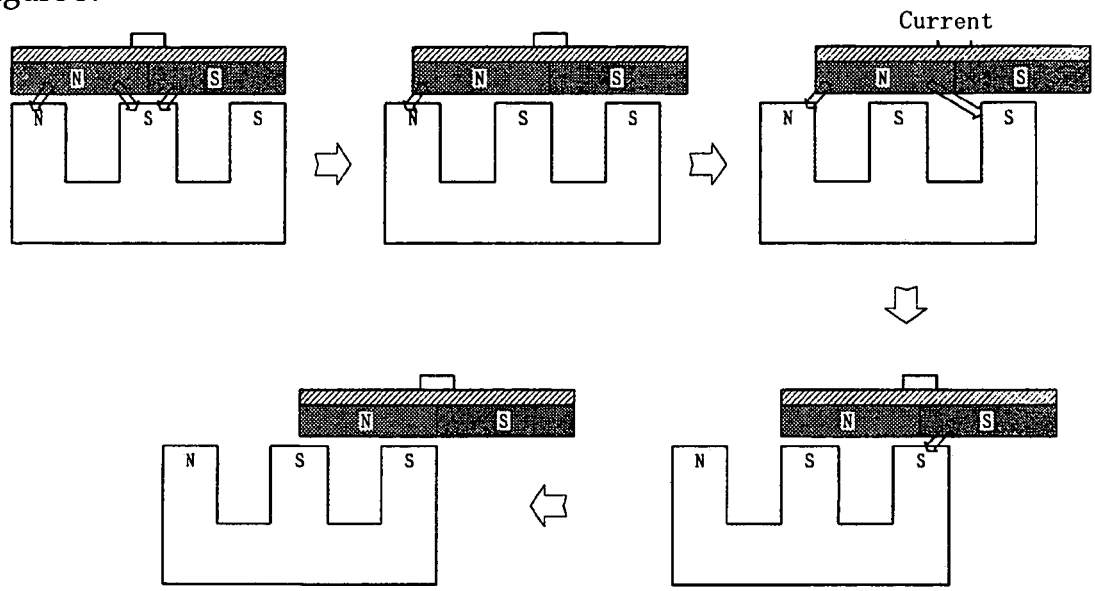
FIG. 3 is a detailed view of FIG. 2.

The selective switching principle between movable contact 12*b* formed in switching part 12 of multi-contact relay 10 and fixed contact 13*a* formed in fixed contact part 13 will now be described. As shown in FIGS. 2 and 3, when power is supplied only to first activated coil 11*b* of operational part 11, and the current of the power voltage 14 is applied to a ground GND 15 along the first activated coil 11*b*, a magnetic field is generated in the direction of the first vertical terminal 11*a*-1 based on Ampére's law, which states that the direction of the force is determined by a current and a magnetic field. First vertical terminal 11*a*-1 has the N-pole, and the remaining two vertical terminals 11*a*-2 and 11*a*-3 have the S-pole. Therefore, the N-pole of permanent magnet 12*a* of switching part 12 repels first vertical terminal 11*a*-1 because they both have the N-pole. This causes switching part 12 to move toward the right. Switching part 12's movement toward the right is subsequently stopped by the attractive force it senses from the second and third vertical terminals 11*a*-2 and 11*a*-3, which have the S-pole. When switching part 12 is in such a position, movable contact 12*b* is aligned with first fixed contact 13*a*-1 of fixed contact part 13.

Figure 4:
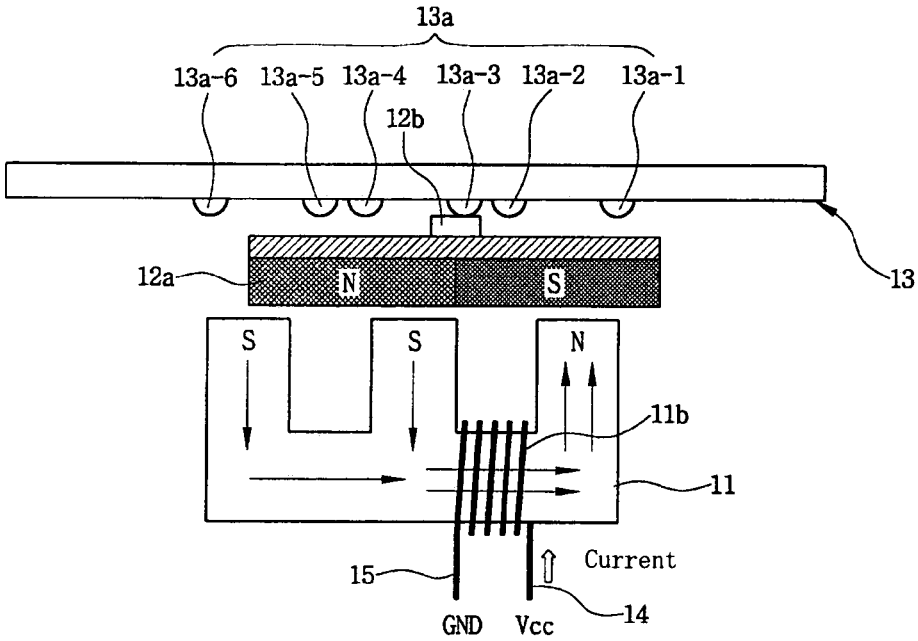
FIG. 4 illustrates an operation state when a current is applied to a second activated coil.
Figure 5:
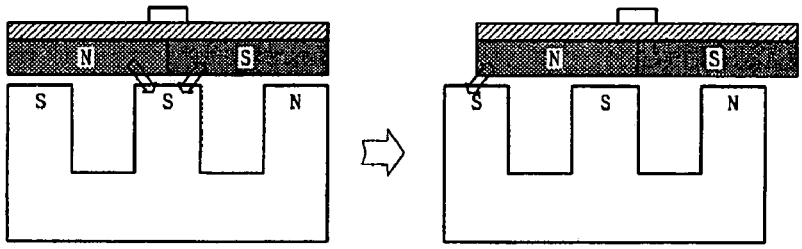
FIG. 5 is a detailed view of FIG. 4.
Figure 6:
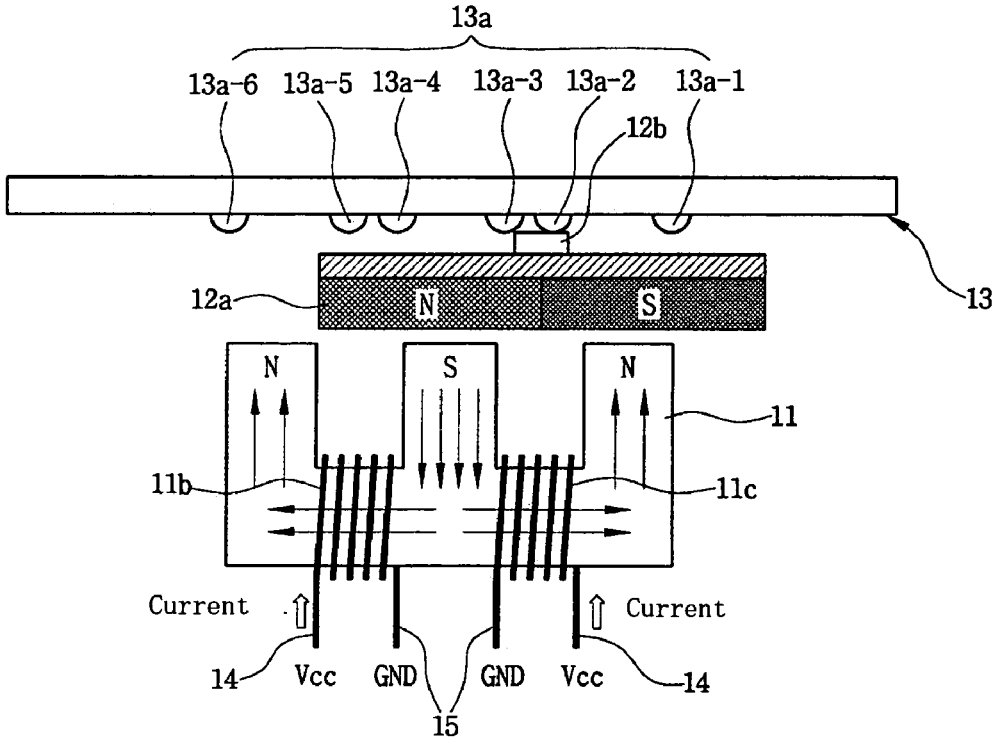
FIG. 6 illustrates an operation state when a current is applied to first and second activated coils.
Figure 7:
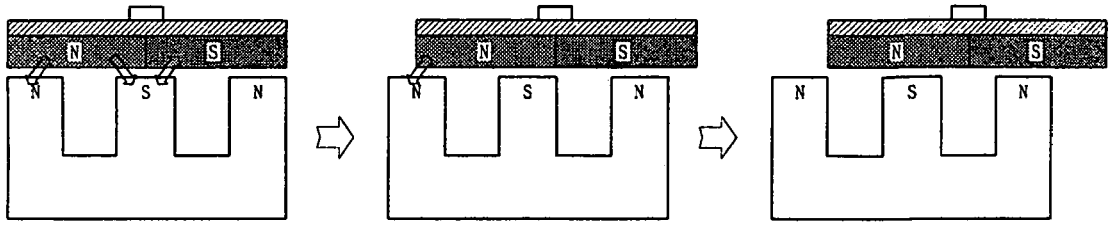
FIG. 7 is a detailed view of FIG. 6.

As shown in FIGS. 4 and 5, when the power is supplied to only second activated coil 11*c* of operational part 11, and the current of the power voltage 14 is grounded through the ground source 15 through second activating coil 11*c*, the magnetic field is formed in the direction of third vertical terminal 11*a*-3 based on Ampére's law. Therefore, third vertical terminal 11*a*-3 now has the N-pole, and the remaining two vertical terminals 11*a*-1 and 11*a*-2 have the S-pole. At this time, the current direction of second activating coil 11*c* is opposite to the direction of first exciting coil 11*b*. The direction of the magnetic field by the second exciting coil 11*c* is preferably opposite to the direction of FIG. 2. The switching part 12 operates differently from the above described first method. Attractive and repulsive forces are generated between the N-pole and S-pole formed in permanent magnet 12*a* of switching part 12 in accordance with an operation of the S-pole of second vertical terminal 11*a*-2 of operational part 11. Therefore, switching part 12 is slightly moved in the right direction, and movable contact 12*b* of switching part 12 is switched to third fixing contact 13*a*-3 of fixing contact part 13.

In addition, when power is supplied to first activated coil 11*b* and second activated coil 11*c* of operational part 11, and current is applied to the ground 15 through first activated coil 11*b* and second activated coil 11*c*, respectively. The magnetic field is formed in the directions of the first and third vertical terminals 11*a*-1 and 11*a*-3. Therefore, the first and third vertical terminals 11*a*-1 and 11*a*-3 have the N-pole, and the second vertical terminal 11*a*-2 has the S-pole. The N-pole of permanent magnet 12*a* of switching part 12 repels the N-pole of the operational part 11 and is attracted to the S-pole. Therefore, switching part 12 stops at the intermediate position as shown in the drawings.

Figure 8A:
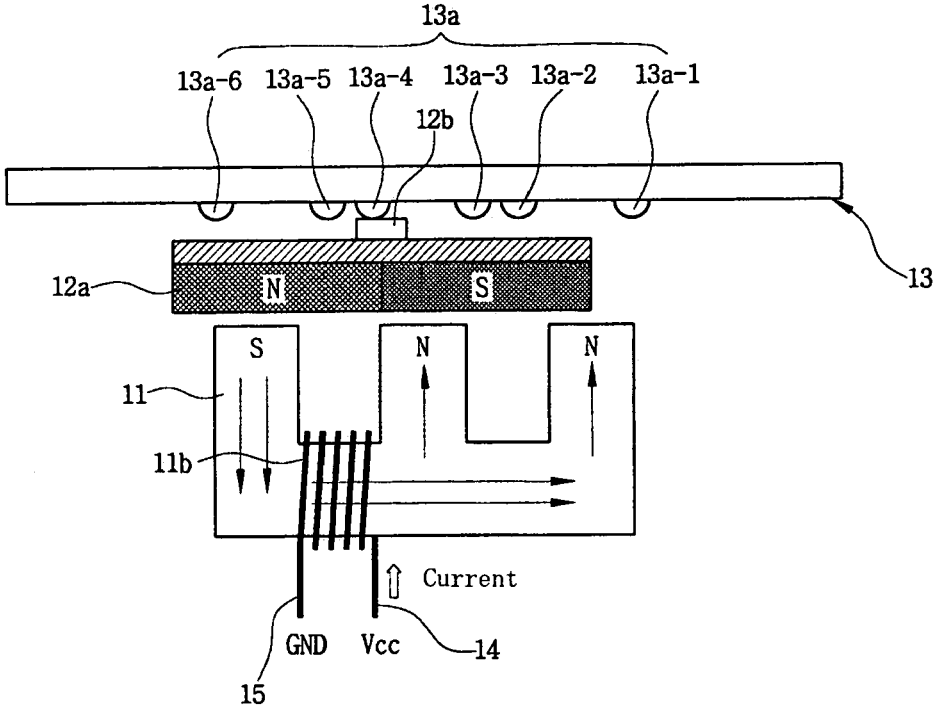
FIGS. 8A through 8C illustrate positions of a switching part when a second vertical terminal is an N-pole.
Figure 8B:
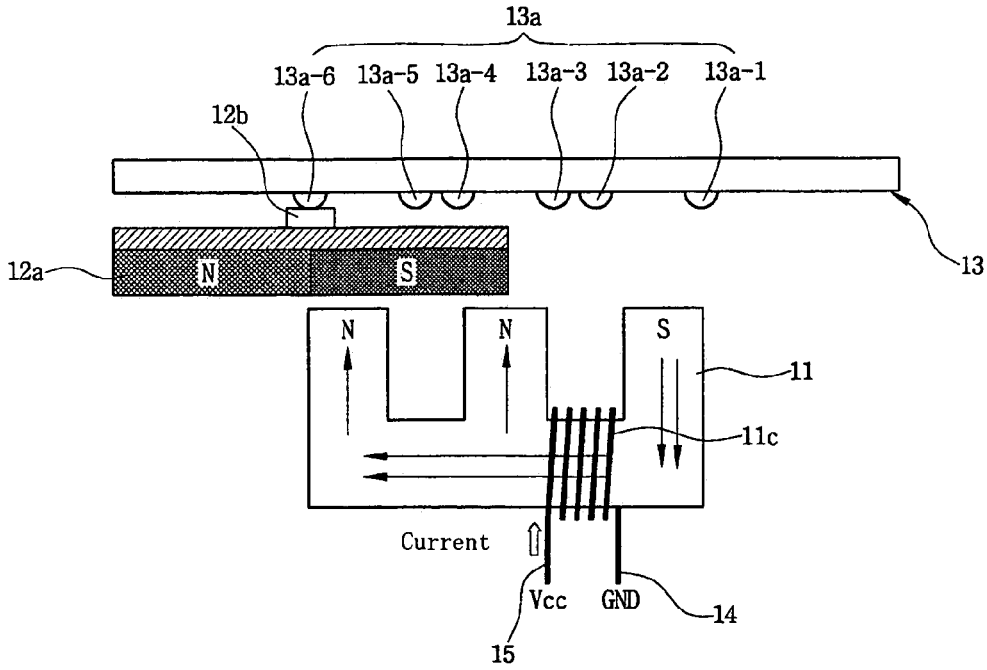
Figure 8C:
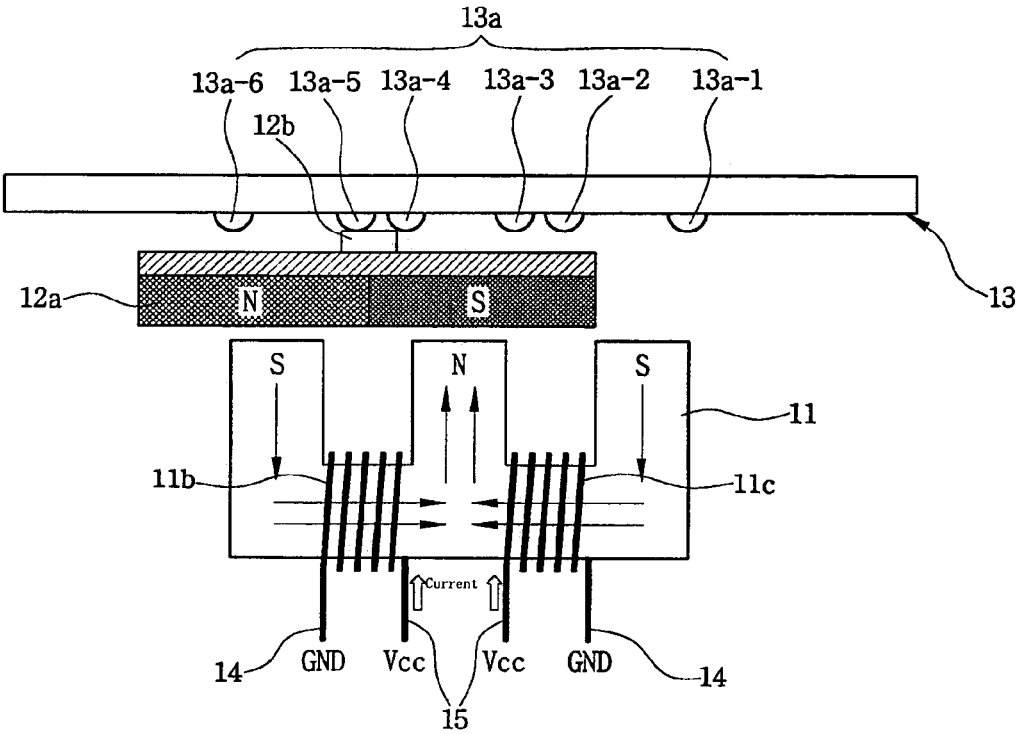

Movable contact 12*b* of switching part 12 can also be switched to second fixed contact 13*a*-2 of fixed contact part 13. The direction of the current flowing through first and second activated coils 11*b* and 11*c* is changed to the opposite direction so that the N-pole is formed at second vertical terminal 11*a*-2. The switching operation is performed with respect to the remaining fixed contacts 13*a*-4, 13*a*-5 and 13*a*-6 in the same method as the above method. FIGS. 8A through 8C shows the remaining operations. FIG. 8A shows switching to fourth fixed contact 13*a*-4, FIG. 8B shows switching to fifth fixed contact 13*a*-5, and FIG. 8C shows switching to sixth fixed contact 13*a*-6.

Figure 9:
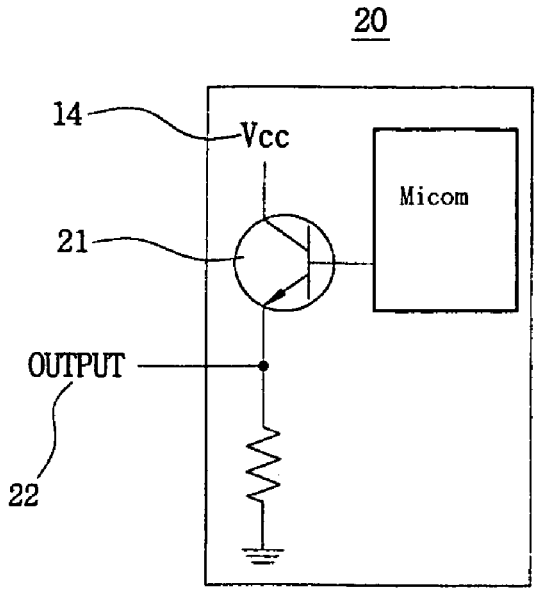
FIG. 9 is a circuit diagram of an internal circuit construction of BCM.

So, switching part 12 may be switched to six positions based on the power applied to two activated coils 11*b* and 11*c*. When fixed contact 13*a* is installed based on each position of movable contact 12*b*, it is possible to independently switch to one of six contacts. Here, as shown in FIG. 1, the power supplied to first and second activating coils 11*b* and 11*c* is supplied to the internal circuit of BCM 20. As shown in FIG. 9, in a state that transistor 21 is off, an output of OUTPUT 22 is 0V (GND), and when the transistor is on, OUTPUT 22 has a value of Vcc-Vce. Here, Vcc represents a power voltage, and Vce represents a voltage at a collector and an emitter of the transistor.

The internal circuit construction of BCM 20 may be implemented in various forms. BCM 20 interprets a signal from each switch 30 and supplies power to four OUTPUT lines 22 based on the on and off operation of transistor 21. The line may be connected with the ground GND, thereby controlling a relay 10. Switching to the six contacts may be controlled by changing the on and off of the transistor 21.

Additionally, the position of switching part 12 of relay 10 may be changed based on the cross section areas and types of vertical terminals 11*a*-1 through 11*a*-3 formed in operational part 11, and the shapes and magnetization characteristics of permanent magnet 12*a*. When the structures of vertical terminals 11*a*-1 through 11*a*-3 or permanent magnet 12*a* are changed, switching part 12 should be designed to return to the original position when the power is not supplied to the activated coils 11*b* and 11*c*.

In the multi-contact type relay controlled by an electromagnet according to the present invention, when the values of the currents from the BCM 20 are changed to different values (except for the values of on and off), it is possible to control switching part 12 to many different positions including the above-described six contact positions.

Figure 10:
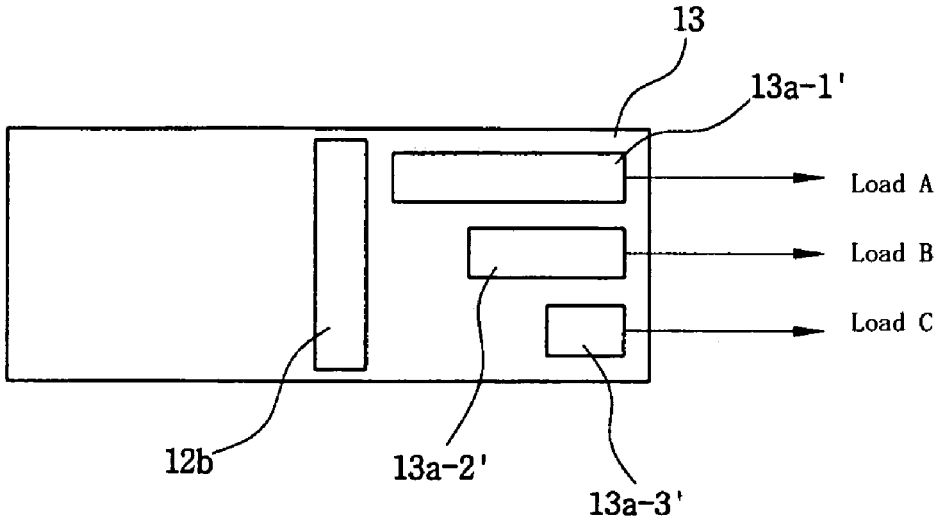
FIG. 10 illustrates a multi-contact type relay controlled by an electromagnet according to the present invention.
Figure 11:
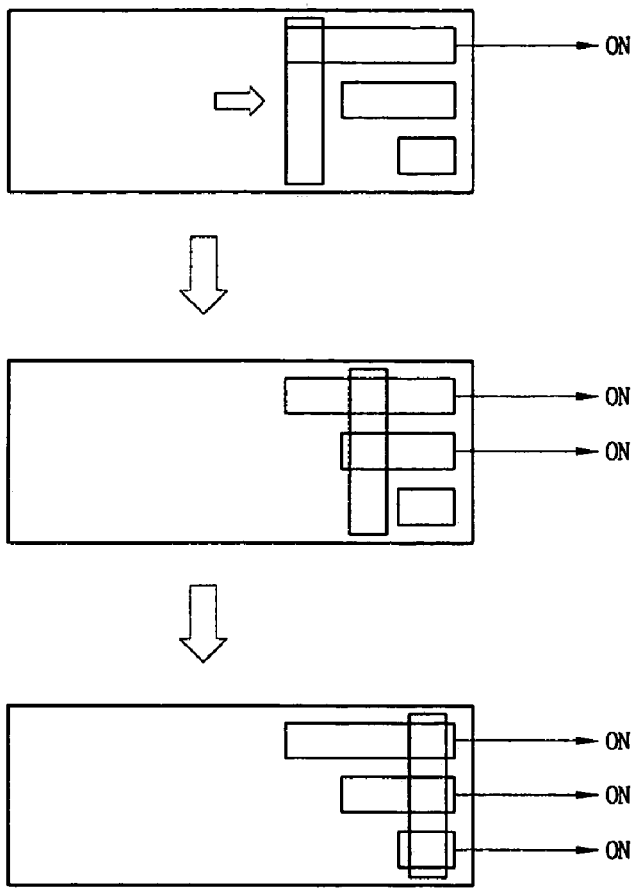
FIG. 11 illustrates an operation of the circuit of FIG. 10.
Figure 12:
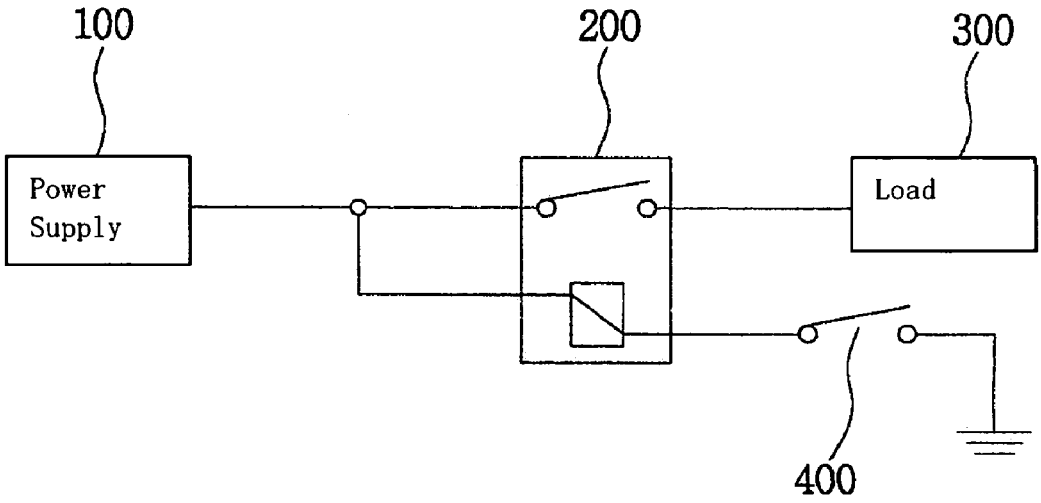
FIG. 12 is a circuit diagram of a circuit construction of a conventional relay.

Further, FIG. 10 is a view illustrating an example of the multi-contact type relay controlled by an electromagnet according to the present invention. As shown therein, fixed contacts 13*a*-1', 13*a*-2', and 13*a*-3' of fixed contact part 13 are arranged in the vertical direction. The positions and shapes of the contacts are changed based on the functions for implementing an electrical circuit. A plurality of different fixed contacts 13*a*-1', 13*a*-2', and 13*a*-3' are installed in parallel in the vertical direction. As shown in FIG. 11, when movable contact 12*b* of switching part 12 is slid horizontally, the first switching is performed at first fixed contact

13*a*-1' having a longer length, and then second fixed contact 13*a*-2' is switched. Finally, first, second, and third fixed contacts 13*a*-1', 13*a*-2', and 13*a*-3' are concurrently switched. Three loads connected with them are operated step-by-step or are operated in series.

The above construction is designed to achieve a series operation of the loads. This construction may be adapted to various elements. As described above, in the multi-contact type relay controlled by an electromagnet according to the present invention, six relays are combined in maximum. The relays may be formed modularly. The manufacturing cost is decreased, and, since many elements are shared, and the numbers of the electromagnetic cores and exciting coils are decreased, the lightness of the product is achieved.

What is claimed is:

1. A multi-contact type relay, controlled by an electromagnet, the relay configured so that power is supplied to a load through a BCM (Body Control Module) in accordance with a switching signal from an integration type switch, and coils are activated in accordance with each switching signal from the BCM thereby forming contacts, relay comprising:

an operational part forming an E-shaped steel core, the operational part comprising:

three vertical terminals;

a horizontal part that horizontally connects the three vertical terminals; and first and second activated coils connected to a power voltage source and wound around the horizontal part between the connections of the horizontal part with the three vertical terminals;

a switching part positioned above the operational part, the switching part having a permanent magnet and a movable contact that are moved horizontally to the left or right based on a repulsive force and an attractive force generated by an electromagnetic force of the first and second activated coils; and a fixed contact part positioned above the switching part and has a plurality of fixed contacts selectively switched with the movable contact of the switching part that is movable in the left and right directions.

2. The multi-contact type relay in claim 1, wherein said first and second activated coils are wound on the horizontal part of the operation unit in the same direction, and the position of the movable contact of the switching part is changed by changing the direction of the current.

3. A multi-contact type relay, controlled by an electromagnet, the relay configured so that power is supplied to a load through a BCM (Body Control Module) in accordance with a switching signal from an integration type switch, and coils are activated in accordance with each switching signal from the BCM thereby forming contacts, relay comprising:

an operational part forming an E-shaped steel core, the operational part comprising:

three vertical terminals;

a horizontal part that horizontally connects the three vertical terminals; and first and second activated coils connected to a power voltage source and wound around the horizontal part between the connections of the horizontal part with the three vertical terminals;

a switching part positioned above the operational part, the switching part having a permanent magnet and a movable contact that are moved horizontally to the left or right based on a repulsive force and an attractive force generated by an electromagnetic force of the first and second activated coils; and a fixed contact part having a plurality of fixed contacts that are positioned above the switching part in the vertical direction with different lengths, wherein one of the plurality of fixed contacts are switched with the movable contact of the horizontal movement of the switching part based on a step-by-step method and a series switching method.

* * * * *